United States Patent [19]

Meyer et al.

[11] 4,223,476

[45] Sep. 23, 1980

[54] BLOCKING TOY VEHICLE

[75] Inventors: Ronald W. Meyer, Cinnaminson, N.J.; Robert A. Jackman, Weston, Conn.

[73] Assignee: Tyco Industries, Inc., Moorestown, N.J.

[21] Appl. No.: 954,143

[22] Filed: Oct. 24, 1978

[51] Int. Cl.[3] ..... A63H 18/12

[52] U.S. Cl. ..... 46/257; 46/202; 273/86 B

[58] Field of Search ..... 46/202, 211, 213, 257, 46/258, 259, 262; 273/86 R, 86 B

[56] References Cited

U.S. PATENT DOCUMENTS

| | | | |
|---|---|---|---|
| 119,927 | 10/1871 | Gallagher | 46/201 |
| 1,041,677 | 10/1912 | Sadtler | 46/202 |
| 2,035,081 | 3/1936 | Lower | 46/201 |
| 2,051,749 | 8/1936 | Schmid | 46/211 |
| 2,387,859 | 10/1945 | Schmidt | 46/202 X |
| 2,767,986 | 10/1956 | Newberry | 46/202 X |
| 3,634,969 | 1/1972 | Hartling et al. | 46/243 |
| 4,078,798 | 3/1978 | Nielsen | 276/86 B |

*Primary Examiner*—F. Barry Shay

*Attorney, Agent, or Firm*—Seidel, Gonda, Goldhammer & Panitch

[57] ABSTRACT

A toy vehicle having collectors thereon which are adapted to contact conductive strip's along a track is adapted to move at a substantially constant speed and provided with first and second guide means projecting laterally with respect to the vehicle body at spaced locations thereon. Each guide means terminates in a free end projecting downwardly for entry into a groove. Said guide means and groove cooperate to guide the vehicle around turns in the track. The guide means free ends and the grooves have a width differential which is less the width differential between each collector and its conductive strip. The guide means are mounted so that they may be mounted to project to one or to the other side of the vehicle.

8 Claims, 5 Drawing Figures

FIG. 1
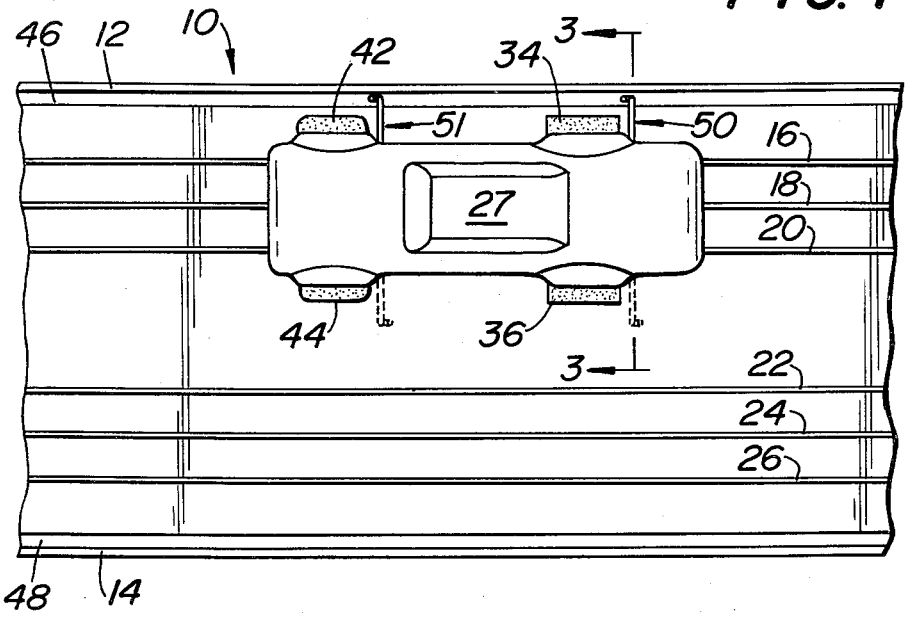
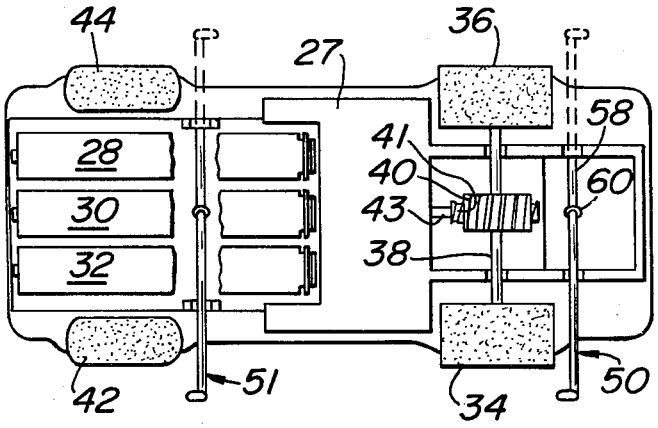
FIG. 2

BLOCKING TOY VEHICLE

BACKGROUND

A toy vehicle of the general type which moves at a substantially constant speed along a track. Such a vehicle may have its front wheels canted in a manner so as to restrict motion of the vehicle to a specific lane of the track. When the car encounters a reverse curve in the track or is bumped by another car, it may depart from its desired lane of travel.

SUMMARY OF THE INVENTION

The present invention is directed to a toy vehicle having a body mounted on wheels. A motor means is provided on the body and coupled to a pair of the wheels for propelling the body along the track. First and second guide means project laterally with respect to the body at spaced locations. Each guide means terminates in a free end projecting downwardly for entry into a groove in a track.

A preferred embodiment of the invention includes a track having upstanding side walls with a groove adjacent each such side wall. The free ends of said means extend into the groove so as to provide certainty that the vehicle can negotiate reverse curves without changing lanes. The guide means are preferably constructed in a manner so as to be convertible whereby they may project to either side of the vehicle body. As a result thereof, the toy vehicle may move along either side wall of the track.

It is an object of the present invention to provide a novel toy vehicle having means for guiding the vehicle with respect to a groove disposed to one side of the vehicle.

It is another object of the present invention to provide a guide means for a toy vehicle which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a partial top plan view of a track with the vehicle of the present invention.

FIG. 2 is a bottom plan view of the vehicle of the present invention.

Figure 3:
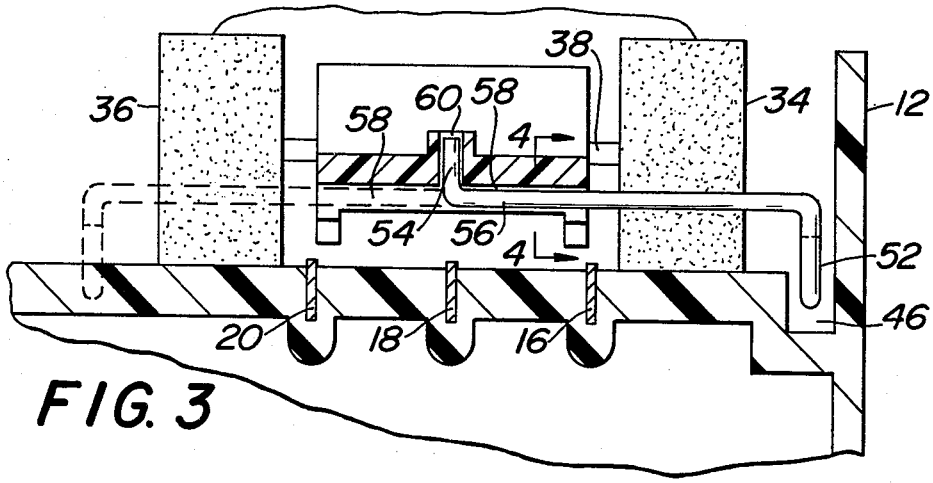
FIG. 3 is a sectional view taken along the line 3—3 in FIG. 1.

Referring to the drawing in detail, wherein like numerals indicate like elements, there is shown in FIG. 1 a portion of a track 10. The track 10 may be in a closed loop with or without reverse curves. The track is provided with upstanding side walls designated 12 and 14.

The top surface of the track has a first set of conductive strips 16, 18 and 20. The top surface of the track has a second set of conductive strips 22, 24 and 26. A track 10 as described up to this point is conventional.

A vehicle designated generally as 27 is provided for riding at a substantially constant speed along the track 10 adjacent the wall 12 or adjacent the wall 14. The vehicle 27 is small having preferred dimensions of about 3 inches in length and a width of about 1¼ inches but is not limited to said dimensions. As is conventional, the vehicle 27 is provided with collectors 28, 30 and 32 which are adapted to contact the above-mentioned sets of conductors for coupling an electric current to a motor supported within the vehicle 27 and not shown. The motor drives the rear wheels 34, 36.

The rear wheels 34, 36 are fixedly connected to an axle 38. Axle 38 has a gear 40 thereon meshed with a worm 41. Worm 41 is connected to motor output shaft 43. In this manner, the motor drives the rear wheel 34, 36 to propel the vehicle 27 along the track 10. For the purposes of the present invention, the manner in which the motor drives the vehicle 27 may be conventional. The vehicle 27 has front wheels 42, 44 which may be supported in any conventional manner.

As shown more clearly in FIGS. 1 and 3, the track 10 is provided with a recessed groove 46 adjacent side wall 12 and a similar groove 48 adjacent side wall 14. The grooves 46, 48 are part of a means for guiding the vehicle 27 as it moves along the track 10. First and second guide means 50, 51 are supported by the vehicle 27 and project laterally with respect to the vehicle at spaced locations. Since each of the guide means 50, 51 is identical, only guide means 50 will be described in detail.

Figure 5:
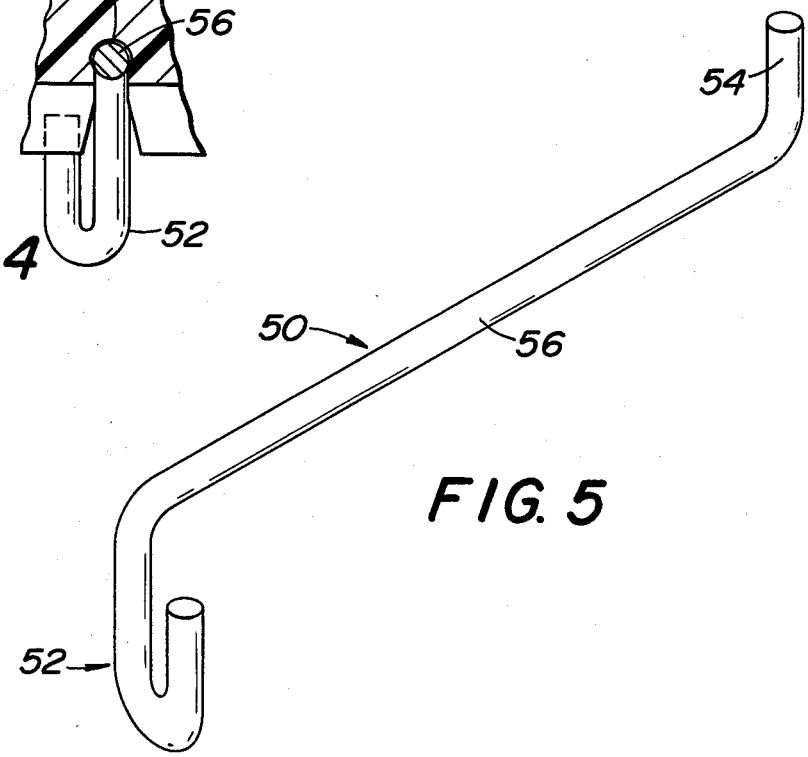
FIG. 5 is a perspective view of a guide means.

Referring to FIG. 5, the guide means 50 is in the form of a wire pin having a free end portion 52 adapted to enter the groove 46 or 48. Portion 52 extends downwardly from a shank 56 which is horizontally disposed as shown more clearly in FIG. 3. The other end of the guide pin has a vertically disposed pivot portion 54.

On a lower surface of the vehicle 27, there is provided a transversely disposed groove 58. In the position shown in FIG. 3, the shank 56 is snapped into one half of the groove 58. The pivot portion 54 extends into a hole 60 disposed generally along a central portion of the vehicle 27.

When in use, each of the guide means 50, 51 extends to the same side of the vehicle 27 so that the free end portion of each guide means extends downwardly into the grooves 46 but does not contact the bottom of the groove. If it is desired to have the vehicle 27 guided by the groove 48, each of the guide means 50, 51 is pivoted to a position as shown in phantom in FIGS. 1, 2 and 3. In order to pivot guide means 50 from the solid line position to the phantom position, force is exerted on the end portion 52 so as to release the shank 56 from one-half of the groove 58. Thereafter, the guide means 50 is pivoted about portion 54 through an arc of 180°. Thereafter, pressure is applied to the guide means 50 to snap the shank 56 into the other half of the groove 58.

The pivotal motion of guide means 50 from the solid line to phantom position is in a counterclockwise direction in FIG. 2 so as to avoid contact with the wheels 34, 36. Guide means 51 pivots in a clockwise direction in FIG. 2. The collectors 28, 30 and 32 are releasably at one end to facilitate pivotal movement of the guide means 51.

Figure 4:
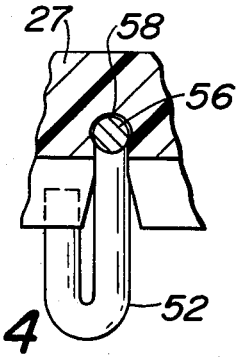
FIG. 4 is a sectional view taken along the line 4—4 in FIG. 3.

As shown more clearly in FIGS. 4 and 5, free end portion 52 is bent back on itself for added strength. Typical dimensions for the means to guide vehicle 27 includes grooves 46, 48 having a width of about 0.63 inches and means 50, 51 being a steel wire having a diameter of about 0.32 inches. Portion 52 has line contact with the side faces of the grooves 46, 48. The collectors 28, 30, 32 remain in contact with their respective conductors at all times since the width of the collectors greatly exceeds the width differential between member 52 and grooves 46, 48.

The present invention may be embodied in other specific forms without departing from the spirit or essential attributes thereof and, accordingly, reference should be made to the appended claims, rather than to the foregoing specification, as indicating the scope of the invention.

We claim:

1. A toy vehicle comprising a body mounted on wheels, motor means cn said body drivingly coupled to a pair of said wheels for propelling the body along a track, first and second guide means projecting laterally with respect to said body at spaced locations for cooperating with a groove in a track so that the body will be propelled by said pair of wheels parallel to the groove, each guide means terminating in a free end portion projecting downwardly for entry into a groove, each guide means including a guide pin, each guide pin having a pivot portion at an end thereof opposite said free end portion, the free end portion and the pivot portion being interconnected by a horizontally disposed portion embraced by said body, the horizontally disposed portion being parallel to the axis of rotation of said pair of wheels.

2. A toy vehicle in accordance with claim 1 wherein each said horizontally disposed portion is embraced by a groove in said body.

3. A toy vehicle in accordance with claim 1 including means on the body defining a pivot mounting in a central part of the body for each guide means so that each guide means may pivot through an arc of 180° to thereby extend to either side of the body.

4. A toy vehicle in accordance with claim 1 wherein said free end portion is bent back on itself so as to be of double thickness.

5. Apparatus comprising a track having upright side walls, a groove in the track adjacent each side wall, a toy vehicle supported by said track, said vehicle including a body mounted on wheels, motor means on said body for propelling the body along said track, said track having first and second sets of conductive strips located between said grooves for transmitting electrical energy to said motor means, said vehicle having collectors, each collector being wider than and in contact with one of said conductive strips, first and second guide means mounted in stable positions on said body at spaced locations, each guide means projecting laterally with respect to said body, each guide means terminating in a free end portion projecting downwardly into one of said grooves, and each guide means being mounted on said body by means whereby it is selectively movable to another stable position so that its free end portion may project downwardly into the other of said grooves.

6. Apparatus in accordance with claim 5 wherein each guide means is mounted on the body for pivotal movement from said first position wherein it projects laterally to one side of the body to said other position so as to project laterally from the opposite side of the body, whereby said first and second guide means may be utilized with either of said grooves.

7. Apparatus in accordance with claim 5 wherein said free end portion is bent back on itself.

8. Apparatus in accordance with claim 5 wherein the width of each collector with respect to its conductive strip is greater than the width differential between said free end portions and said one groove.

* * * * *